United States Patent [19]

Suominen

[11] 4,360,355

[45] Nov. 23, 1982

[54] ADHESIVE ENVELOPE FOR A SHIPPING LABEL OR THE LIKE

[76] Inventor: Heikki S. Suominen, Tampere, Finland

[21] Appl. No.: 188,158

[22] Filed: Sep. 17, 1980

Related U.S. Application Data

[63] Continuation-in-part of Ser. No. 160,394, Jun. 17, 1980, abandoned, which is a continuation of Ser. No. 913,147, Jun. 6, 1978, abandoned.

[51] Int. Cl.[3] ..... B31B 41/60

[52] U.S. Cl. ..... 493/196; 156/252; 156/289; 493/222; 493/224; 493/335; 493/347; 493/961

[58] Field of Search ..... 493/193–197, 493/346, 347, 381, 382, 220, 222, 224, 223, 961, 362, 361, 335, 379; 156/554, 537, 251, 252, 253, 324, 513, 515, 289; 229/69

[56] References Cited

U.S. PATENT DOCUMENTS

| | | | |
|---|---|---|---|
| 2,819,195 | 1/1958 | Huber | 156/554 X |
| 3,210,908 | 10/1965 | Samberg | 493/196 X |
| 3,327,416 | 6/1967 | Sanford | 493/379 X |
| 3,355,090 | 11/1967 | Werby | 229/69 |
| 3,612,390 | 10/1971 | Howard | 229/69 |
| 3,750,538 | 8/1973 | Confer | 493/370 X |
| 3,776,798 | 12/1973 | Milano | 229/69 X |
| 4,087,312 | 5/1978 | Maltese | 156/554 X |
| 4,174,597 | 11/1979 | Mowli et al. | 493/224 X |

FOREIGN PATENT DOCUMENTS

| | | | |
|---|---|---|---|
| 14123 | of 1852 | United Kingdom | 493/224 |

*Primary Examiner*—James F. Coan

*Attorney, Agent, or Firm*—Pollock, Vande Sande & Priddy

[57] ABSTRACT

An improved method of simultaneously manufacturing a plurality of envelope assemblies of the type used to affix an insert such as a shipping label to a container. A plurality of separate strips of plastic material are arranged side-by-side on a single backing sheet of plastic material. Separate layers of adhesive are affixed to portions of the backing sheet extending on either side of each strip of plastic, with a separate, removable covering strip applied to each layer of adhesive until used. Each of the separate strips of plastic material is heat sealed to the backing sheet to create an envelope and slits are cut through portions of each plastic strip to provide entry into and exit from the respective envelopes. Finally, the plastic strips and backing sheet are cut to separate the envelopes from one another.

7 Claims, 4 Drawing Figures

ADHESIVE ENVELOPE FOR A SHIPPING LABEL OR THE LIKE

CROSS-REFERENCE TO RELATED APPLICATION

This application is a continuation-in-part of pending application Ser. No. 160,394 filed June 17, 1980, and now abandoned, by the same inventor, namely Keikki S. Suominen; said application Ser. No. 160,394 being a continuation of application Ser. No. 913,147 filed June 6, 1978 by Heikki S. Suominen and now abandoned.

BACKGROUND OF THE INVENTION

This invention relates to a new and useful method of simultaneous mass manufacture of transparent envelope assemblies adaptable for receiving shipping labels or the like. In particular, the present invention concerns manufacturing of adhesive envelopes adaptable for easily fastening documents and the like to sides of shipping containers.

Known envelope assemblies usually require a layer of adhesive on a first envelope surface which folds over and seals an insert therein, and a separate layer of adhesive entirely covering a second envelope surface for attaching the envelope to a shipping container. This results in a complicated envelope assembly which must be separately sealed shut and affixed to the container. In addition, a layer of protective material, such as paper, intially covers the adhesive material to prevent inadvertent adhesion and is peeled away and disposed of immediately prior to attachment of the envelope to the container.

The excessive use of adhesive materials and especially the excessive use of protective paper greatly increases the manufacturing costs without providing any increased operating benefits.

For example, U.S. Pat. No. 3,327,416 issued June 27, 1967 to Sanford suggests a transparent envelope which is attached to a shipping container by means of a plurality of adhesive strips covering more than one-half the envelope surface abutting the container.

U.S. Pat. No. 3,355,090 issued Nov. 28, 1967 to Werby suggests manufacturing a plurality of transparent envelopes one after aother from a strip which can be addressed accordingly. There is no suggestion in Werby of simultaneously manufacturing a plurality of envelopes from an enlarged strip of transparent, two-ply plastic material.

Finally, Finnish Patent Application No. 760,982 also suggests a transparent envelope requiring the entire surface abutting the container to be covered by adhesive, and which is not adaptable to simultaneous, mass manufacture.

As will be described in detail hereinafter, the present invention overcomes the problems confronting the prior art through the novel placement of narrow layers of adhesive material which functions to attach the envelope directly to a container, while at the same time sealing an insert within the envelope.

OBJECTS OF THE PRESENT INVENTION

An object of the present invention is to provide an adhesive envelope adaptable for attachment to a shipping container through an effective placement of a plurality of layers of adhesive material.

A further object of the present invention is to provide an improved envelope assembly wherein layers of adhesive material function to attach an envelope to a container, while at the same time sealing an insert therein.

A further object of the present invention is to provide a new and improved method for simultaneously manufacturing a plurality of envelopes from separate rolls of plastic material arranged on a single backing sheet.

Another object of the present invention is to provide an envelope which is inexpensive to manufacture and is easily packaged and attached to an appropriate shipping container.

According to a preferred embodiment of the present invention, a plurality of separate strips of plastic material are arranged side-by-side on a single backing sheet of plastic material. Layers of adhesive material are affixed to portions of the single backing sheet extending adjacent to side portions of each strip of plastic material. A separate removable covering layer is attached to each adhesive strip and confronting surface portions of adjacently disposed strips of adhesive are punched out. The strips of plastic are heat sealed into permanent attachment with the backing strip along confronting edge surfaces and at least one slit is cut through a portion of each plastic strip to allow a shipping label or the like to be inserted into and removed from a pocket formed between each plastic strip and a portion of the backing sheet attached thereto. Finally, the separate strips and backing sheet are cut to separate the plurality of separate enveloped from one another.

These and other objects of the present invention will become apparent from the following specification and claims, together with the accompanying drawings, wherein similar elements within each preferred embodiment are referred to and indicated by similar reference numerals.

BRIEF DESCRIPTION OF THE DRAWINGS

The present invention can be best understood with reference to the accompanying drawings, wherein.

DETAILED DESCRIPTION OF THE PREFERRED EMBODIMENTS

Figure 1:
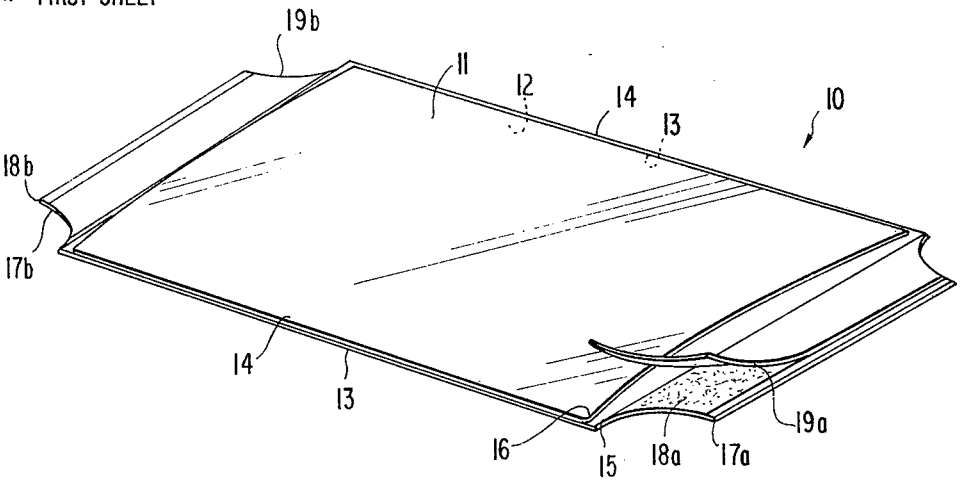
FIG. 1 shows a perspective view of a preferred embodiment of the present invention.

Referring to the drawings, and FIG. 1 in particular, a preferred embodiment of an adhesive envelope 10 is shown in perspective. Envelope 10 comprises a generally rectangular-shaped rear side 11 and a generally rectangular-shaped front side 12 of a greater length than side 11. Rear side 11 is intended to abut a shipping container (not shown).

Front and rear sides 12 and 11 may be formed from a plastic material with at least the front side being transparent and are attached along their opposite edges 13 and 14, respectively, while remaining unattached along edges 15 and 16. As will be discussed hereinafter, sides 11 and 12 may be heated sealed at edges 13 and 14 during the manufacturing process.

Side 12 includes a pair of end portions 17*a* and 17*b* extending beyond the unattached edges 15 and 16 of side 11. Layers of adhesive material 18*a* and 18*b* are affixed to surface portions 17*a* and 17*b*, facing side 11, respectively, by ordinary lamination methods or through the use of conventional adhesive tape.

Strips of protective tape 19*a* and 19*b* cover adhesive layers 18*a* and 18*b*, respectively, in order to prevent the adhesive material from prematurely adhering to other surfaces. The tape may be made from a paperlike material and is peeled from contact with the adhesive surface immediately prior to attachment off the envelope to a container.

It is noted that an insert can be easily positioned within envelope 10 due to the unjoined edges 15 and 16. Once an insert is in position between sides 11 and 12, the adhesive layers 18*a* and 18*b* are broght into contact with the container surface. This structure eliminates the need for separate adhesive layers for sealing the envelope. As will be discussed hereinafter in greater detail, sides 12 and 11 may also be heated and permanently seamed together during the manufacturing process.

Figure 3:
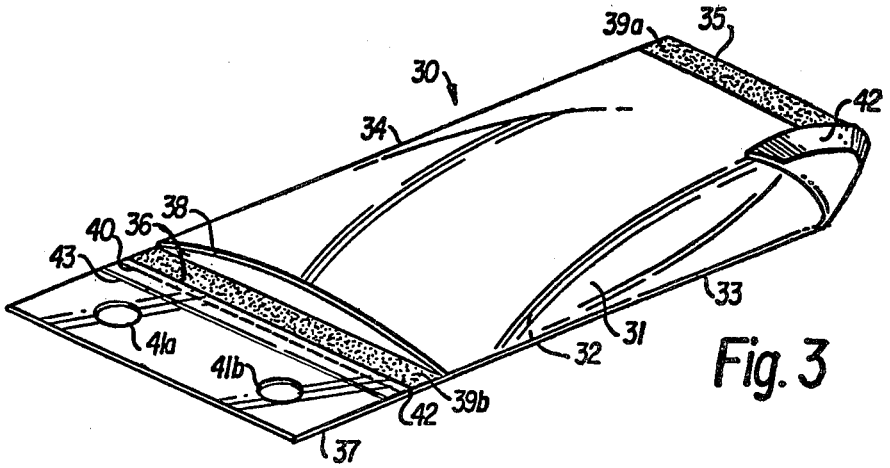
FIGS. 3 and 4 show perspective views of further preferred embodiments according to the present invention.

Referring to FIG. 3, a further embodiment comprises an envelope 30 shown in perspective. Envelope 30 may be formed from plastic material and includes a rectangularly-shaped, rear side portion 31 and a rectangularly-shaped, front side portion 32 of a greater length, with opposite confronting edges 33–35 being heat sealed together. Edge 36 of rear side portion 31 is also heat sealed to an abutting surface of front side 32, with a generally rectangular portion 37 of front side 32 extending beyond edge 36.

A single incision 38 cuts completely through rear side 31 from edge 33 to edge 34, and is positioned proximate to edge 36. A pair of rectangular-shaped, adhesive layers 39*a* and 39*b* are attached to rear side 31, with layer 39*a* positioned adjacent edge 35 and layer 39*b* positioned between incision 38 and edge 36. Side 32 is perforated at 40 with one or more aperture 41*a* and 41*b* formed in portion 37 of front side 32.

Protective tapes, similar to the previously discussed embodiment, may initially cover adhesive layers 39*a* and 39*b* with the tapes being disposed of prior to attachment to a container. In a further embodiment, the tapes may be replaced with a coating of silicone emulsion or similar agent which is applied directly to those outwardly facing portions of front side 32 oposite from adhesive layers 39*a* and 39*b*. The silicone coating prevents a plurality of packaged enveloped from prematurely adhering to one another.

A plurality of envelopes 30 may be stacked with the silicone surfaces 42 of one envelope contacting the adhesive strips 39 of an abutting envelope 30 to prevent undesirable adherence. The bundle of envelopes 30 may be attached to one another at 43 by a heat sealing process and then hung from fixtures extending through apertures 41*a* and 41*b*. Each of the envelopes 30 can be individually detached by tearing along perforations 40 as required.

During operation, an insert is positioned between sides 31 and 32 via incision 38 and the adhesive layers 39*a* and 39*b* are brought into contact with a container surface. As the adhesive attached to the container, the incision is effectively blocked with the insert being sealed within the enveloped.

Figure 4:
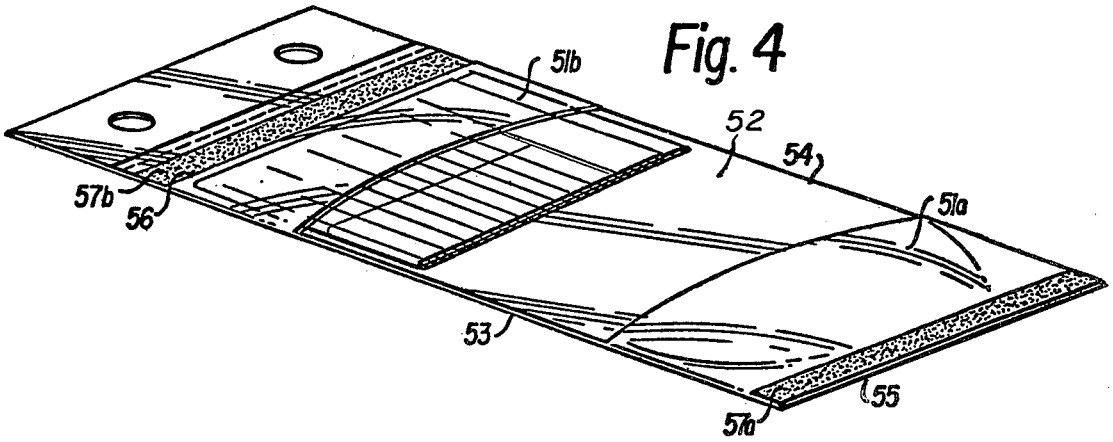

Referring to FIG. 4, a further embodiment is shown which is basically similar to the embodiment of FIG. 3. Rather than cutting an incision in a rear side 51, a central rectangular portion of rear side 51 is removed, leaving a pair of spaced flap portions 51*a* and 51*b*. Flap 51*a* is attached to front side 52 along edges 53, 54, and 55. An insert 56 is securable between sides 51*a*, 51*b* and 52 as adhesive layers 57*a* and 57*b*, positioned on sides 51*a* and 51*b*, are brought into attachment with a container surface.

Figure 2:
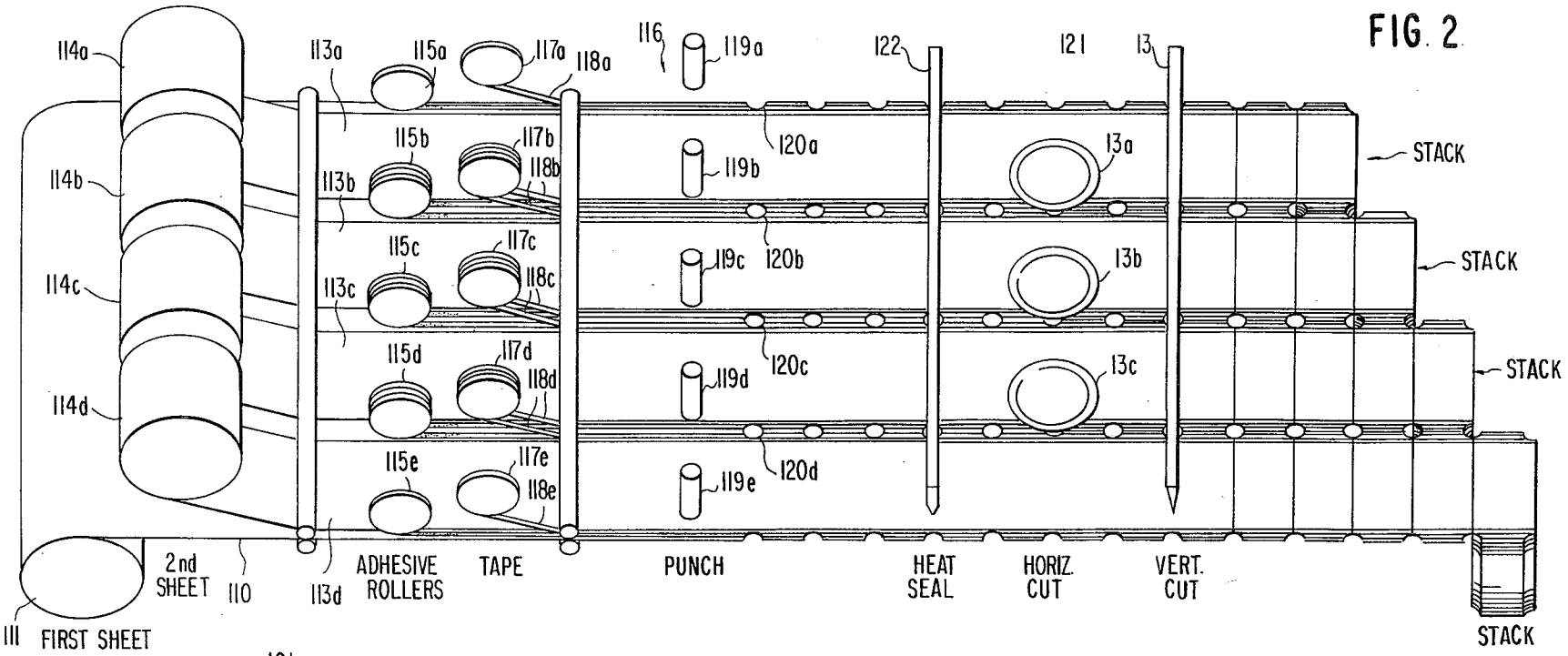
FIG. 2 shows a top view of a plurality of envelopes undergoing a manufacturing process according to the present invention.

Turning now to FIG. 2, a novel method of mass producing envelopes of the type described hereabove will now be explained in detail. A continuous sheet 110 of plastic sheet material is fed from a roll 111 through a first work station generally indicated by numeral 112. Simultaneously, a plurality of separate strips of plastic material 113*a*, 113*b*, 113*c* and 113*d* are also fed side-by-side into the work station 111 from container rolls 114*a–d*, respectively. The number of separate strips of plastic material employed is considered to be entirely a design choice, provided that the combined width of the strips 113*a–d* is less than the width of sheet 110.

After plastic strips 113*a–d* are arranged on plastic sheet 110, the combination of plastic sheets is advanced from work station 112 toward work station 116. As the sheets 113*a–d* and 110 pass under rollers 115*a–e*, a separate layer of adhesive material is affixed to each portion of sheet 110 extending between adjacent plastic strips 113. After passing under adhesive applicator rollers 115*a–e*, the combination of strips and sheet passes under tape rollers 117*a–e*, wherein strips of tape covering material 118*a–e* are applied to each layer of adhesive to prevent the adhesive from premature adhesion to other surfaces. After the adhesive and tape covering layers are applied to sheet 110, the combination of sheets enters work station 116.

A plurality of aligned punch members 119*a–e* are brought into annd out of contact with the layers of adhesive and covering tape to punch a series of generally circular-shaped openings 120*a–d* through the adhesive and tape as well as through sheet 110. The punch members 119*a–d* are aligned so as to simultaneously contact the layers of adhesive at intervals corresponding to the desired width of the envelopes to be formed for a reason which will become clear. After receiving punch opening 120*a–d*, sheet 110 and strips 113*a–d* travel from work station 116 toward station 121.

During this interval, the strips 113*a–d* and sheet 110 pass under a conventional heat sealing device generally indicated at 122. Heat sealing device 122 may constitute a bar-shaped member extending across each of the strips 113*a–d* and sheet 110, with the bar having a longitudinal axis extending substantially perpendicular to the longitudinal axes of the strips 113*a–d*, respectively. The bar may include a V-shaped, reciprocating end portion which simultaneously contacts aligned portions of each of the strips 113*a–d*. The heat sealing device 122 is programmed such that the end portion contacts the strips 113*a–d* only when a series of punched out openings 120*a–d* are vertically aligned with the heat sealing device 122. This means that only portions of strips 113*a–d* are positioned beneath sealing device 122 and are sealed into contact with sheet 110, preventing the adhesive and covering layers from being attached to sheet 110.

After passing under heat sealing device 122, the sheet 110 and attached strips 113*a–d* pass beneath perpendicularly disposed cutters 130*a–c*, 131 which cut through strips 113*a–d* and sheet 110 along the heat sealed surfaces and between the separate strips of plastic to separate the envelopes from one another. The separate envelopes are then stacked for shipment.

The method of manufacturing described hereinabove provides a plurality of separate enveloped each having a configuration similar to the envelope depicted in FIG.

1. However, if it is desired to produce the envelope depicted in FIG. 3, additional sides of each strip 113*a–d* can be heat sealed to the plastic sheet 110 and slits can then be cut through the strips 113*a–d* as required to insert a shipping label into the envelope. Likewise, if it is desired to provide an extended tab similar to the rectangular portion 37 in FIG. 3, the spacing between strips 113*a–d* is appropriately widened. Finally, while the preferred method contemplates that the strips 113*a–d* and sheet 110 pass between work stations 112, 116 and 121, it is considered within the scope of the present invention to have the heat sealing, cutting and adhesive laying devices move across fixedly positioned plastic strips and sheet material.

In a further method of manufacturing, sheets 111 and 112 may be identically sized and heat sealed together both longitudinally and transversely to produce a plurality of closed envelopes. A plurality of adhesive layers are attached to one of the sheets and a plurality of incisions are appropriately cut in one of the sheets to allow for placement of an insert therein. Finally, a plurality of strips of protective tape are pre-cut and attached to the adhesive layers to prevent premature adherence.

A silicone-type emulsion may be applied directly to the outwardly facing portion of sheet 112, so as to eliminate the need for protective tapes to cover adhesive strips 113. If protective tape is chosen, it can be formed from pre-cut strips of material which are directly attached to adhesive layers 113.

The present invention is not limited to the above described embodiments, but is limited only by the scope of the following claims.

What I claim is:

1. A method for mass producing a plurality of separate, identically-shaped adhesive envelopes of the type employed in attaching an insert to a container surface and the like, said method comprising the following steps:

positioning a plurality of separate strips of plastic material side-by-side on a continuous sheet of plastic material, wherein each strip of plastic material is spaced from adjacently disposed strips of plastic material;

attaching strips of adhesive material to portions of said continuous sheet of plastic material extending between confronting sides of said adjacently disposed strips of plastic material, wherein each strip of adhesive material has an adhesive surface facing away from said continuous sheet of plastic material;

forming aligned openings through a plurality of said strips of adhesive material at preselected intervals corresponding to substantially the uniform width of each resulting envelope;

simultaneously heat sealng a plurlity of said strips of plastic material to said continuous sheet of plastic material along a surface extending between said openings, in a direction substantially perpendicular to said strips of adhesive material;

simultaneously cutting through a plurality of said separate strips of plastic material and said attached continuous sheet of plastic material along said heat sealed surface; and cutting through each layer of adhesive material and attached continuous sheet of plastic material along a line extending between adjacent openings formed through said respective layer of adhesive material to separate said envelopes from one another.

2. A method according to claim 1, including the step of covering each layer of adhesive material with a removable strip of protective material.

3. A method according to claim 1, including the step of simultaneously punching said aligned openings through each layer of adhesive material.

4. A method for mass producing a plurality of separate, substantially identically-shaped adhesive envelopes of the type employed in attaching an insert to a container surface, and comprising the following steps:

positioning a plurality of separate strips of plastic material side-by-side on a continuous sheet of plastic material, wherein each strip of plastic material is spaced from adjacently disposed strips of plastic material;

attaching strips of adhesive material to portions of said continuous sheet of plastic material extending between confronting sides of said adjacently disposed strips of plastic material;

heat sealing opposite sides of each of said strips of plastic material to confronting surface portions of said continuous sheet of plastic material;

heat sealing portions of each strip of plastic to said continuous sheet of plastic along spaced surfaces extending between opposite sides of each strip of plastic material, thereby forming a plurality of closed enveloped between said strips of plastic material and said continuous sheet of plastic material;

cutting at least one slit through portions of each strip of plastic material forming said closed envelopes; and separating each of said envelopes from one another.

5. A method according to claim 4, including the step of simultaneously heat sealing uniformly spaced portions of each strip of plastic into contact with said continuous sheet of plastic material, wherein said heat-sealed portions each extend in a direction substantially perpendicular to the direction of said strips of adhesive material.

6. A method according to claim 4, including the step of covering each layer of adhesive material with a removable strip of protective material.

7. A method according to claim 4, including the step of simultaneously heat sealing aligned portions of each strip of plastic into contact with said continuous sheet of plastic material.

* * * * *